US005203481A

United States Patent [19]

Dobbins et al.

[11] Patent Number: 5,203,481

[45] Date of Patent: Apr. 20, 1993

[54] SQUEEZE BOTTLE CADDY

[76] Inventors: Ronald E. Dobbins, 10241 Jennrich Ave., Garden Grove, Calif. 92643; William D. Pulliam, 15710 Rosalita Dr., La Mirada, Calif. 90638

[21] Appl. No.: 794,041

[22] Filed: Nov. 19, 1991

[51] Int. Cl.[5] ..... A45F 3/14

[52] U.S. Cl. ..... 224/148; 224/257; 215/100 A; 294/31.2

[58] Field of Search ..... 224/148, 202, 205, 251, 224/257, 258; 215/100 A; 294/31.2; 220/94 R

[56] References Cited

U.S. PATENT DOCUMENTS

| | | | |
|---|---|---|---|
| 1,375,917 | 4/1921 | Paugh | 215/11.6 |
| 1,890,482 | 12/1932 | Weissberg | 215/100 A |
| 3,000,527 | 9/1961 | Jennings et al. | 215/100 A |
| 3,044,659 | 7/1962 | Tupper | 220/94 R |
| 3,275,366 | 9/1966 | Hidding | 294/31.2 |
| 3,463,536 | 8/1969 | Updegraff et al. | 215/100 A |
| 3,612,595 | 10/1971 | Uppegraff et al. | 215/100 A |
| 3,653,610 | 4/1972 | Owen | 215/100 A |

*Primary Examiner*—Linda J. Sholl
*Attorney, Agent, or Firm*—G. Donald Weber, Jr.

[57] ABSTRACT

A collar (also referred to as a caddy) adapted to be attachable to a bottle or related container for providing safe, hands-free access to a fluid bottle or related container which has a relatively wide mouth and a screw-on top or lid. Such caddy can be attached with a strap to hang over a shoulder, bicycle, or car seat to prevent spilling any liquid from the bottle. The collar is useful to permit the bottle to be joined to a carrying strap to enhance the utility of the bottle during athletic activities or during leisure time pursuits. The collar is preferably fabricated of a plastic material such as polypropylene, polyethylene or other durable material. However, the collar has "break-away" ends so that the strap is removable in ordinary circumstances and the collar will break in response to forces generated in unusual circumstances.

10 Claims, 1 Drawing Sheet

SQUEEZE BOTTLE CADDY

BACKGROUND

1. Field of the Invention

This invention relates, generally, to a suspensory device for use with bottles or containers and, more particularly, to a device for facilitating a hands-free suspension of a bottle or container from the body of an individual, thus allowing for unencumbered physical activity yet allowing for easy access to said container.

2. Prior Art

The decades of the seventies and eighties spawned a new awareness among many individuals worldwide and especially in the United States that the maintenance of good health is a very serious and neverending process. Out of this awareness developed an entire health and fitness industry emphasizing the individual and maintenance of a healthy body via exercise and proper nutrition.

Many aerobic activities such as long-distance running, jogging, hiking, biking, weight training and combination activities such as the so-called "iron man" activities and triathlo competitions have become extremely popular. These activities have spawned their own very successful commercial niche within the overall health and fitness industry.

Much of this commercialization has been concerned with the relationship that exists between aerobic exercise and proper nutrition and more specifically, the relationship between exercise and fluid and electrolyte replacement. As a result, many products such as the highly successful electrolyte replacement formulation GATORADE distributed by the PowerBurst Company of Fresno, Calif., have become commonplace household items.

However, despite all the advances in fluid replacement technology and related product development, the problem of how to efficiently deliver or make the fluids available to the exercising individual remained a significant problem. The earliest attempts involved the us of canteens and other water or fluid containers such as jugs or jars or even cups of all descriptions. These products had major shortcomings in that they could not be easily carried by the exercising individual and, more specifically, they required the individual to stop his activity to gain access to the fluid contents.

Significant progress was achieved with the introduction of a modified soft-sided plastic bottle/container with a specially designed spout allowing for consumption of the fluid without removing the bottle cap or lid. Examples of this type of product are Nalgene Trail Products manufactured by Nagle Company of Rochester, N.Y.; Igloo Products manufactured by Igloo Products Company of Houston, Tex.; Open Country multi-use bottle manufactured by The Metal Ware Corporation of Two Rivers, Wis., and many others.

The problem still remained as to how such a fluid delivery product could be effectively utilized without significantly impairing the user's ability to perform the desired activity and/or exercise. If the user were forced to physically hold the bottle or container, he (or she) would not be able to utilize his (or her) hands during any activity or exercise. If the user decided not to physically hand-carry the bottle, her (or she) would either lose the use of the product or be severely limited in the element of mobility or movement during his or her activity or exercise program.

Given this realization, certain products have been introduced to the market that attempt to address this problem. Such products as the AQUA GEAR line marketed by the NIKE Corporation attempt to address this problem of access and mobility by providing an external carrier for the container or bottle that can be attached to the belt or worn around the neck of the user by way of appropriate straps. However, this approach addresses the mobility problem but does not address the access problem. By providing an external carrier for the container or bottle, the user has access only to the upper or spout portion of the bottle and not the soft squeezable or pliable side portions. This physical limitation prevents the user from completely accessing the fluid contents of the bottle without physically stopping his or her activity and removing the bottle from the external carrier.

The idea that a runner, jogger, biker or hiker needs to have hands-free access to the actual fluid container or bottle while having said container or bottle securely attached to the body of the user in such a manner as not to interfere with the user's activity and/or exercise program remains unaddressed by these approaches.

One product known in the art consists of a single, relatively rigid plate or collar with a central aperture. The neck portion of a bottle may be inserted into the aperture and the cap of the bottle screwed back on the bottle neck to hold the collar in place. The collar (with attached bottle) is suspended by appropriate straps that are inserted into slots or openings in the collar and may be worn around the user's neck. This device enhances mobility and access related to the bottle carried thereby. However, this device has the significant drawback that it creates a significant safety hazard when the freely swinging suspended bottle or the support strap becomes entangled with some obstruction. The possibility of serious injury to the user due to this neck strap device is obvious. Therefore, it is desirable to provide an improved device that addresses not only the issues of access and mobility by the user but also the issue of user safety while remaining cost effective.

SUMMARY OF THE INSTANT INVENTION

This invention is directed to a collar (or caddy) whereby a refillable fluid reservoir, bottle or similar container may be freely suspended or supported relative to the body of the user or any other support structure. This is accomplished in a manner that provides for hands-free positioning of the reservoir, bottle or related container while at the same time providing a mechanism for quick release in the event that the device becomes entangled or caught up in some injury-threatening manner.

The collar is of single plate construction with a central aperture therethrough. The plate is, generally, oval shaped. The size of the central aperture may be selected in such a manner as to accommodate bottles or containers of different neck diameters. Additionally, there are T-shaped slots at either end of the oval shaped planar surface for insertion of shoulder and neck suspensory or support straps. The T-shaped slots are formed by the opposed, but spaced apart, ends of the plate which approximate a C-shaped end portion.

The device is of one piece construction and, therefore, requires no assembly other than to insert the suspensory or support straps in the appropriate T-shaped slots. The T-shaped slots, located at opposite ends of the planar surface, are defined by a pair of opposing ends or fingers. These opposing ends or fingers are fabricated so that they are capable of breaking away in the event the strap, container and/or bottle becomes caught or entangled in some manner.

Another feature of the invention is that it is very lightweight and requires very little space to store when not being utilized. This feature makes it an ideal product for use by backpackers and individuals engaged in similar activities where space and weight are critical considerations.

CO-PENDING APPLICATION

The co-pending application Ser. No. 07/634,317, now U.S. Pat. No. 329,964, SQUEEZE BOTTLE CADDY, is a design patent application covering the same invention and filed by the same inventors.

DESCRIPTION OF A PREFERRED EMBODIMENT

Figure 1:
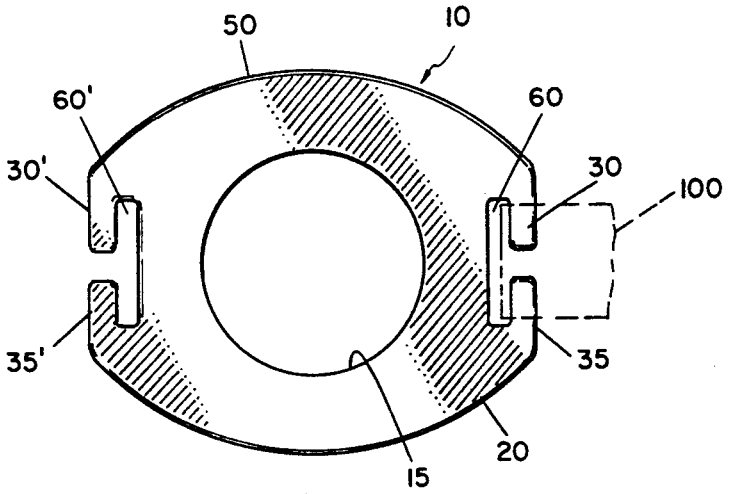
FIG. 1 is a top view of the invention.

Referring now to FIG. 1, there is shown a top surface view of the bottle collar (or caddy) 10 of the instant invention.

The caddy 10 includes a relatively thin, generally oval shaped body formed of a suitable, strong, lightweight material such as Lexan (or the like) with a generally planar upper surface 20. A relatively large, generally circular central aperture 15 extends completely through said body. Typically, the aperture 15 is of close tolerance with the neck portion of conventional squeeze bottles known in the art. A pair of T-shaped slots 60 and 60' are located at opposite ends of said body. The T-shaped slots 60 and 60' have the cross-bar of the T formed within the body of the caddy 10. The vertical portion of the T-slot communicates with the cross-bar of the T-slot and extends to the perimeter of the body. This configuration creates the pairs of opposed ends or fingers 30, 35 and 30', 35'. (Alternatively, it can be considered that the ends of the caddy 10 are formed in a C-shape.)

The slots 60 and 60' are adapted to receive end loops (or other portions) of a support strap 100 (one end of which is shown in dashed outline). The strap (typically made of polypropylene) engages the opposed fingers 30, 35 and 30', 35'. In normal usage, these fingers are sufficiently strong to support the caddy 10 and the associated bottle. However, one or more of the fingers 30, 35 and 30', 35' is designed to bend and/or break if the strap engages some obstruction wherein a significant force is applied to the caddy 10 via strap 100. When the finger (or fingers) breaks, the strap is freed from the caddy 10 and is disengaged from the user. Thus, the safety hazard of the prior art devices is obviated. Of course, if the strap 100 is disengaged because the finger (or fingers) is bent, the caddy is then reused by reattaching strap 100 back to caddy 10 at 30, 35 and 30', 35'.

Figure 2:
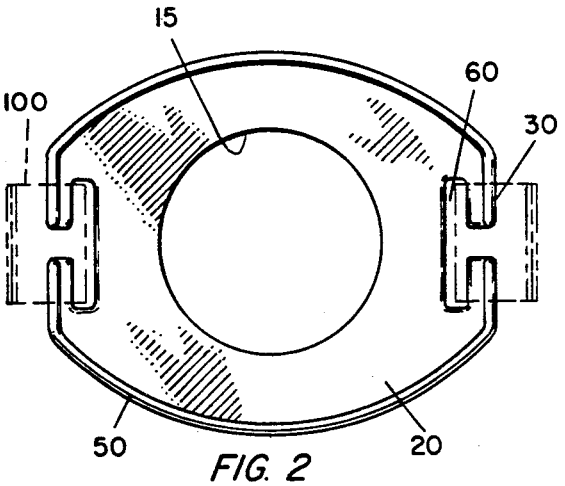
FIG. 2 is a bottom view of one embodiment of the invention.

Referring now to FIG. 2, there is shown a bottom view of one embodiment of the invention. The plan view of the bottom is similar to the plan view of the top surface of the caddy 10. However, as shown in FIG. 2, the caddy 10 includes a bead 50 around the perimeter thereof. The bead 50 provides a strengthening rib for the body of caddy 10 and inhibits caddy 10 from bending or breaking. In this embodiment, the bead 50 is formed on at least one side of the fingers 30, 35 and 30', 35'. Typically, the bead 50 is integrally formed with the body of caddy 10 in an injection molding process.

Figure 3:
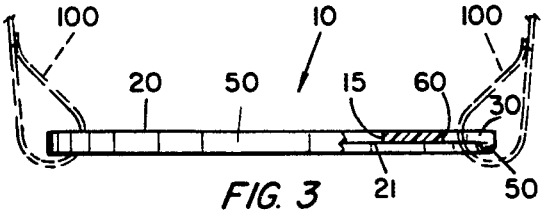
FIG. 3 is a side elevational view, partially broken-away, of the embodiment of the invention shown in FIG. 2.

Referring now to FIG. 3, there is shown a partially broken-away side view of caddy 10 of the instant invention. As noted, the caddy 10 consists of an upper planar surface 20. As shown in FIG. 3, caddy 10 includes the lower planar surface 21 with elevated external perimeter lip or bead 50. The ends of support strap 100 are shown looped around the finer 30, for example.

Figure 4:
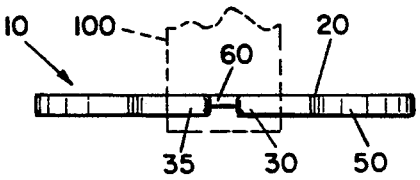
FIG. 4 is an end elevational view of the embodiment of the invention shown in FIG. 1 showing the opening to one of the T-shaped slots and the pair of opposing ends or fingers defining the slot.

Referring now to FIG. 4, there is shown a side or edge view of caddy 10 rotated 90° from the showing in FIG. 3, further showing the opening to T-shaped slot 60 and opposing ends 30 and 35 defining a portion of the slot. A support strap 100 is inserted into slot 60 where it is held in place by opposing ends 30 and 35. Should the strap become entangled or hung up in some manner, ends 30 and/or 35 will break or give way in response to the increased pressure. Thus, the strap 100 is immediately released from the collar 10 and the user will not encounter serious harm or injury.

Figure 5:
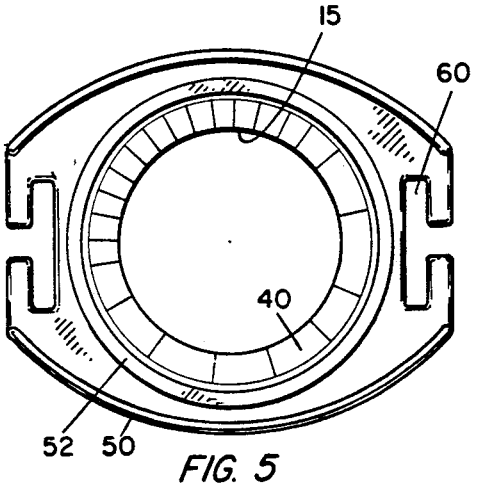
FIG. 5 is a bottom view of another embodiment of the invention.

Referring now to FIG. 5, shown there is a bottom plan view of another embodiment of caddy 10 of the instant invention. As noted, caddy 10 includes a central aperture 15 wherein the neck portion of a bottle (or similar container) is inserted and the bottle cap is screwed down onto the neck, securing the caddy to the bottle.

In the embodiment shown in FIG. 5, the central aperture 15 is surrounded by a tapered perimeter portion 40. The tapered perimeter portion 40 is thinner adjacent the aperture 15 and enlarges to the thickness of the surrounding planar surface 20. This tapered portion 40 provides a seat for engaging the upper surface of bottle neck portions in certain bottles of appropriate design. This capability greatly increases the utility of caddy 10. An elevated perimeter lip 52 extends from the bottom surface of caddy 10 and surrounds the tapered portion 40. The lip 52 provides insertion stability for the bottle and provides a seal for bottles with somewhat elongated necks. In addition, the caddy 10 is capable of preventing the bottle from collapsing.

Figure 6:
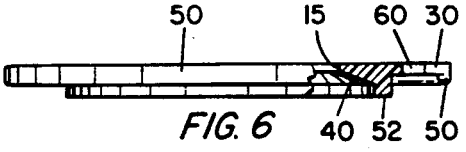
FIG. 6 is a side elevational view, partially broken-away, of the embodiment of the invention shown in FIG. 5 showing the opening to one of the T-shaped slots and the pair of opposing ends or fingers defining the slot.

Referring now to FIG. 6, there is shown a partially broken-away side view of caddy 10. A portion of the tapered perimeter 40 is shown in partially broken-away section. Tapered perimeter 40 is angled downwardly away from the planar surface 20. The tapered portion 40 forms an insertion col±ar that can expand upon the insertion of a bottle or reservoir neck portion and seal or conform tightly to said neck portion following insertion. The seal 52 extends downwardly from the larger end of the tapered portion 40. The finger 30 (with bead 50) forms the slot portion 60.

Figure 7:
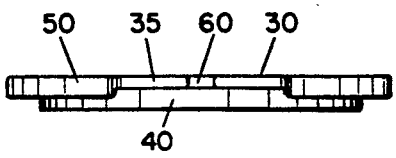
FIG. 7 is an end elevational view of the embodiment of the invention shown in FIG. 5, showing the opening to one of the T-shaped slots and a pair of opposing ends or fingers defining the slot.

Referring now to FIG. 7, shown there is a side or edge view of caddy 10. The opposing ends 30 and 35 define T-shaped slot 60. Shown also is elevated perimeter lip 50 which is formed at the perimeter of tapered perimeter portion 40 of central aperture 15.

As is best seen in FIGS. 1, 2 and 5, both sets of opposing ends 30, 35 and 30', 35' are of the same dimensions in terms of thickness and length. Both sets of opposing ends are fabricated to be sturdy enough to accept the insertion of a support strap and the weight involved with a fully filled fluid bottle. However, the primary advantage of this configuration resides in the safety release factor built into both pairs of opposing ends 30, 35 and 30', 35'. As previously noted, the user is protected from incurring serious injury or harm by the fact that the opposing ends are not solid (as is the prior art) and will bend or break away when the bottle or strap becomes entangled or hung up in some manner. Typically, between 13 and 25 pounds of pressure are adequate and sufficient to cause the deformation of the caddy fingers.

Thus, there is shown and described a unique design and concept of a device which allows for complete hands-free access to a fluid reservoir or bottle in complete safety by an individual even during periods of intense physical activity or exercise. The particular configuration shown and described herein relates to a structurally simple, durable and inexpensively-made device that has applications to a complete spectrum of athletic activities, as well as leisure pursuits. The embodiment shown here may be utilized by children as well as adults. While this description is directed to a particular embodiment, it is understood that those skilled in the art may conceive modifications and/or variations to the specific embodiments shown and described herein. Any such modifications or variations which fall within the purview of this description are intended to be included therein as well. It is understood that the description herein is intended to be illustrative only and is not intended to be limitative. Rather, the scope of the invention described herein is limited only by the claims appended hereto.

We claim:

1. A collar for a container comprising a relatively thin planar body having a generally elliptical configuration, a relatively large aperture through the central portion of said planar body and adapted to receive a neck of a container, strap retaining apertures formed in said planar body on opposite sides of said aperture, said strap retaining apertures are disposed at the ends of the longer axis of said planar body, at least one of said strap retaining apertures formed by a discontinuous portion of said planar body which is adapted to be deformed under prescribed load conditions.

2. The collar recited in claim 1 including, an enlarged edge portion around a substantial portion of the periphery of said body.

3. The collar recited in claim 1 wherein, said large aperture is circular in configuration.

4. The collar recited in claim 1 including, a lip which extends from said body adjacent the perimeter of said large aperture.

5. The collar recited in claim 1 wherein, said at least one strap retaining apertures have a T-shape configuration.

6. The collar recited in claim 1 including, strap means having at least portions thereof retained by said strap retaining apertures.

7. The collar recited in claim 4 wherein, said lip is displaced from the perimeter of said large aperture to form a ledge therebetween.

8. The collar recited in claim 7 wherein, said ledge has a tapered configuration with the thin edge at the perimeter of said central aperture and the thick edge at said lip.

9. The collar recited in claim 1 wherein, said body is formed of Lexan.

10. The collar recited in claim 1 wherein, said at least one strap retaining aperture includes a pair of opposed fingers at the perimeter of said body arranged to have a space therebetween.

* * * * *